US008128252B2

(12) United States Patent
Yasuda et al.

(10) Patent No.: US 8,128,252 B2
(45) Date of Patent: Mar. 6, 2012

(54) LIGHTING FIXTURE AND CEILING SYSTEM USING THE SAME

(75) Inventors: Takaki Yasuda, Chiba (JP); Satoshi Shindo, Chiba (JP)

(73) Assignee: Showa Denko K.K., Tokyo (JP)

( * ) Notice: Subject to any disclaimer, the term of this patent is extended or adjusted under 35 U.S.C. 154(b) by 361 days.

(21) Appl. No.: 12/531,011

(22) PCT Filed: Mar. 11, 2008

(86) PCT No.: PCT/JP2008/054404

§ 371 (c)(1),
(2), (4) Date: Sep. 11, 2009

(87) PCT Pub. No.: WO2008/120538

PCT Pub. Date: Oct. 9, 2008

(65) Prior Publication Data

US 2010/0103654 A1 Apr. 29, 2010

(30) Foreign Application Priority Data

Mar. 13, 2007 (JP) ..... 2007-063615

(51) Int. Cl.
*F21S 8/00* (2006.01)

(52) U.S. Cl. ..... 362/147; 362/148; 362/149; 362/150; 362/241; 362/364

(58) Field of Classification Search ..... 362/147, 362/148, 149, 150, 241, 247, 364
See application file for complete search history.

(56) References Cited

U.S. PATENT DOCUMENTS

| | | | | |
|---|---|---|---|---|
| 7,207,698 | B2 * | 4/2007 | Kotovsky et al. | 362/321 |
| 7,780,316 | B2 | 8/2010 | Engel | |
| 7,828,465 | B2 * | 11/2010 | Roberge et al. | 362/294 |
| 2003/0081419 | A1 | 5/2003 | Jacob et al. | |

FOREIGN PATENT DOCUMENTS

| | | | |
|---|---|---|---|
| CN | 1898496 | A | 1/2007 |
| JP | 3562602 | B2 | 4/1997 |
| JP | 11-324210 | A | 11/1999 |
| JP | 2003-328494 | A | 11/2003 |
| JP | 3562602 | A | 9/2004 |
| JP | 3562602 | B2 | 9/2004 |
| JP | 2005-506672 | A | 3/2005 |
| TW | 370138 | | 9/1999 |
| TW | 394353 | | 6/2000 |

* cited by examiner

*Primary Examiner* — Stephen F Husar
*Assistant Examiner* — James Cranson, Jr.
(74) *Attorney, Agent, or Firm* — Sughrue Mion, PLLC

(57) ABSTRACT

A lighting fixture which comprises a ceiling frame equipped with an attachment portion, a hollow portion, and a storage recess, wherein the attachment portion is located at an upper end portion of the frame to be suspended from a ceiling of a building, the hollow portion is located below the attachment portion, and the storage recess is located below the hollow portion; the storage recess has an opening which faces downward, a lighting module is set in the storage recess; and the lighting module includes plural light emitting diodes, a reflector which reflects light emitted from the diodes, and a lighting housing to which the light emitting diodes and the reflector are installed.

8 Claims, 7 Drawing Sheets

LIGHTING FIXTURE AND CEILING SYSTEM USING THE SAME

TECHNICAL FIELD

The present invention relates to a lighting fixture which can be attached to a ceiling such as that of a clean room, and a ceiling system using the lighting fixture.

Priority is claimed on Japanese Patent Application No. 2007-063615, filed Mar. 13, 2007, the content of which is incorporated herein by reference.

BACKGROUND ART

A lighting fixture 100 having a ceiling frame structure as shown in FIGS. 7A to 7C is conventionally known for a clean room which is, for example, used in a manufacturing step or an inspection step of precision instruments or used at institutions and the like. A ceiling frame 101 comprised in the lighting fixture 100 has a structure such that an attachment portion 102 positioned at the upper end of the frame is suspended from the ceiling (slab) of a building, and lighting equipment 110 such as a fluorescent light 110*a* is attached to the bottom surface of a main frame 10, which is located at the lower portion of the ceiling frame, so that the lighting equipment 110 is protruded. Furthermore, in the step conducted after the lighting fixture 100 is attached to the ceiling, a power distribution cable 111 can be wired in a hollow portion 104, which is located within the ceiling frame 101 of the lighting fixture 100, in order to make it possible to provide a power supply to the lighting equipment 110.

A lighting fixture such as those described above is generally used so that the lighting fixture is attached to the ceiling of a building, and therefore, a frame having a reverse "T" shape as shown as the ceiling frame 101 in illustrated examples is used for the lighting fixture in order to enable the attachment of the lighting fixture to a ceiling with screws or the like.

The lighting fixture 100 as shown in FIG. 7A to 7C can be used in combination such that plural lighting fixtures are combined when it is attached to a ceiling, and for example, plural lighting fixtures are combined with a beam-like support to form a grid pattern. Furthermore, a screen panel, a HEPA (High Efficiency Particulate Air) filter unit, an air-conditioning system and the like, which are not illustrated in figures, can be set so that they are fit in between the lighting fixtures 100 and the beam-like support, which are set in a grid pattern, to form a ceiling system used in a room such as a clean room. Here, edges of the air-conditioning system or the like are mounted on a top surface 103*a* of the main frame 103.

However, the lighting fixture 100 such as those shown in FIG. 7A to 7C, which has been used in the conventional clean room, has a structure wherein lighting equipment 110 is protruded toward downward from a main frame 103, and there is a problem that the available floor height of a room is reduced. As a result, for example, space efficiency decreases when the lighting fixture is installed in a clean room where space is limited, and furthermore, a fluorescent lamp 110*a* may be broken by touching the fluorescent lamp with a user's body or an instrument, while various operations are being conducted in the clean room.

Furthermore, in order to secure predetermined available floor height in a clean room or the like while a conventional lighting fixture is used, it is necessary to construct a clean room so that height of the ceiling is increased according to the height of a protruded portion of the lighting fixture 100. Therefore, there was a problem in that construction cost increases. Furthermore, as a result of increasing the height of a ceiling, wasted space is generated in a clean room, and it is necessary to conduct circulation, air conditioning and cleaning of extra air, and therefore, running cost increases.

In order to overcome the aforementioned problems of conventional lighting fixtures and ceiling systems, new lighting fixtures and ceiling systems have been proposed. More specifically, a lighting fixture and system have been proposed wherein a storage recess which can store a luminaire is provided at a main frame of a ceiling frame, a luminaire equipped with a reflective umbrella and a fluorescent lamp is set in the storage recess, and an air introducing hole, which enables air to pass through the reflective umbrella, is provided to the main frame. (For example, Patent Document 1.)

In the lighting fixture having the ceiling frame structure described in Patent Document 1, the space efficiency of a clean room is not reduced since the luminaire is stored in the ceiling frame as described above. Furthermore, construction cost and running cost do not increase since it is not necessary to construct a building so that ceiling height of the room is increased. In addition, it is disclosed in the document that an air introducing hole is provided and air is introduced into the reflective umbrella via the hole, and such a structure prevents dust from covering a tube of a fluorescent lamp.

However, the lighting fixture described in Patent Document 1 has the following problems. One concrete example of a problem is that, when the aforementioned lighting fixture is installed, it is necessary for an electrician to attach a power distribution cable, which is supplied from the upper side of the ceiling such that it hangs down, to every ceiling frame suspended from the ceiling after the ceiling is constructed. Such an attachment requires a lot of work. Furthermore, another concrete example of a problem is that, while the aforementioned power distribution cable is attached to each ceiling frame as feed wiring, it is necessary to strip the end cover of the cable, to connect the stripped cable with a terminal board of each apparatus for a fluorescent lamp, and to attach a fluorescent lamp to each apparatus one by one. Therefore, it is difficult to reduce construction time.

Furthermore, after installing and attaching a lighting fixture, it is necessary to exchange the fluorescent lamps approximately every two years for a clean room, although the frequency varies according to the irradiation time of the luminaire. However, the ceiling frame described in Patent Document 1 has a structure wherein a fluorescent lamp is set in the narrow ceiling frame, and the workability at the time of exchanging a fluorescent lamp is poor. Therefore, there is a problem in that increased work and increased cost are required when maintenance is conducted.

Moreover, since the ceiling frame of Patent document 1 has a structure wherein the air introducing hole is provided as described above, there is a problem in that a fluorescent lamp, a power supply and the like may suffer harmful effects such that a lot of dust may enter the main frame, although such a structure can prevent dust from covering a tube of a fluorescent lamp.

Patent documents 1: Japanese Patent No. 3562602

DISCLOSURE OF INVENTION

Problem to Be Solved by the Invention

The present invention is achieved in view of the above problems, and the purpose of the present invention is to provide a lighting fixture and a ceiling system using the fixture, wherein the lighting fixture is excellent in space efficiency, enables short construction period for installation, is easy to conduct maintenance thereon, is excellent in dustproof properties, and enables a reduction of construction costs and running costs.

Means for Solving the Problem

The inventors of the present invention have conducted intensive research so as to overcome the aforementioned problems, and they achieved the present invention described below.

The first aspect of the present invention is a lighting fixture which comprises a ceiling frame equipped with an attachment portion, a hollow portion and a storage recess, wherein the attachment portion is located at an upper end portion of the frame to be suspended from a ceiling, the hollow portion is located below the attachment portion, and the storage recess is located below the hollow portion; and the storage recess has an opening which faces downward, a lighting module is set in the storage recess, and the lighting module includes plural light emitting diodes, a reflector which reflects light emitted from the diodes and a lighting housing to which the light emitting diodes and the reflector are installed.

The second aspect of the present invention is a ceiling system to which plural lighting fixtures and at least one of an air-conditioning unit, an air filter unit and a screen panel are attached;

each of the lighting fixtures comprise a ceiling frame equipped with an attachment portion, a hollow portion and a storage recess, wherein the attachment portion is located at an upper end portion of the frame to be suspended from a ceiling, the hollow portion is located below the attachment portion, and the storage recess is located below the hollow portion; and the storage recess has an opening which faces downward, a lighting module is set in the storage recess, and the lighting module includes plural light emitting diodes, a reflector which reflects light emitted from the diodes and a lighting housing to which the light emitting diodes and the reflector are installed; and an edge portion of at least one of the air-conditioning unit, the air filter unit and the screen panel is mounted on the top surface of the storage recess of the ceiling system of the lighting fixtures.

It is preferable that the hollow portion be equipped with a distribution cable which supplies a power supply to the aforementioned light emitting diodes.

It is preferable that the hollow portion be equipped with a power supply unit which supplies a power supply to the aforementioned light emitting diodes.

It is preferable that the lighting module be set removably in the storage recess of the ceiling frame.

Effect of the Invention

A lighting fixture and a ceiling system using the lighting fixture of the present invention have the structure wherein a storage recess where a lighting module can be set is provided at a ceiling system, and a lighting module is set in the storage recess. Accordingly, installation for a lighting fixture and a ceiling system can be conducted easily at a setting area such as a clean room or the like, and short construction time is possible. Furthermore, since the lighting module is not protruded to a setting area of the lighting fixture, it is possible to effectively use the space of the setting area.

Moreover, since a lighting module having plural light emitting diodes and a reflector is used, the lifetime thereof is long as compared with lighting which uses an illuminant such as a fluorescent lamp. Accordingly, the frequency of having to exchange the fluorescent lamp and the like which is conducted at the setting area can be decreased. Furthermore, even when it is necessary to exchange the lighting module, an exchange operation can be conducted easily and safely since the lighting module having plural light emitting diodes can be set and removed easily in a single operation. Furthermore, since the lighting module is structured such that it is not protruded outside of the storage recess, it is possible to prevent breakage and the like of the lighting module since a user's body or instruments do not contact the light emitting diode which is a luminescence means, and it is also possible to prevent dust and the like from covering the lighting module.

Accordingly, it is possible to obtain a lighting fixture and a ceiling system using the lighting fixture, which are excellent in space efficiency, workability at the time of installation work, dustproof properties, ease of maintenance, and enabling a reduction in construction costs and running costs.

BRIEF DESCRIPTION OF THE REFERENCE SYMBOLS

Figure 1:
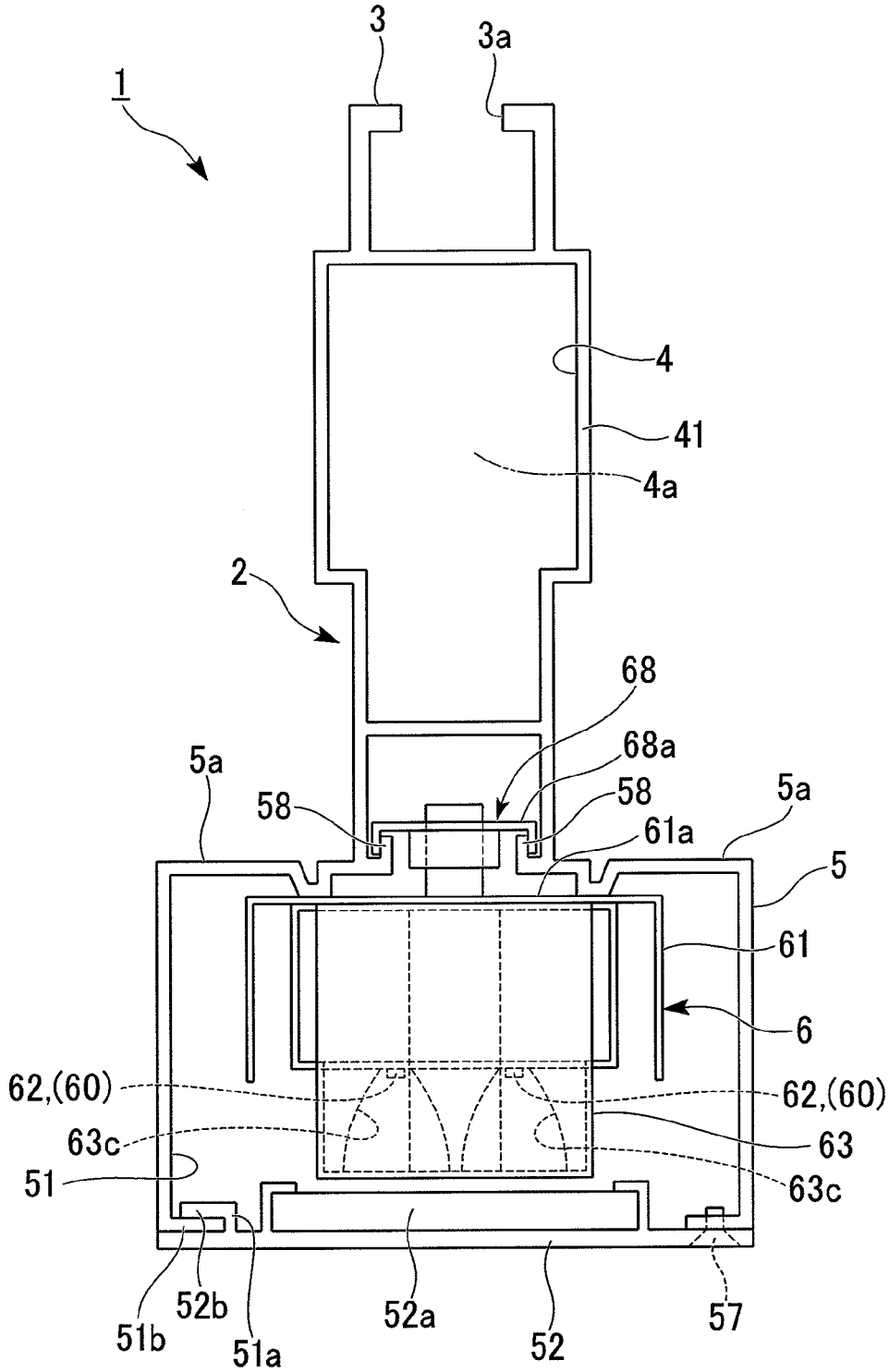
FIG. 1 is a schematic cross sectional view wherein one example of the structure of a lighting fixture according to the present invention is shown.

1: a lighting fixture
2: a ceiling frame
3: an attachment portion
4: a hollow portion
5: a main frame
5*a*: a top surface
6, 70 and 80: a lighting module
7: a cable

8: a power supply unit
10: a ceiling system
11: a ceiling
20: an air conditioning unit
30: an air filter unit
40: a screen panel
51, 90 and 91: a storage recess
61, 71 and 81: a lighting housing
62: a light emitting diode
63: a reflector
63*c:* a reflector opening

BEST MODE FOR CARRYING OUT THE INVENTION

The present invention provides an excellent new lighting fixture. The present invention provides a lighting fixture which includes a ceiling frame having an attachment portion, which is located at the upper end of the frame to be attached to the aforementioned slab of the upper floor, and also includes a hollow portion which is located at the under position of the attachment portion, and furthermore, the storage recess is located at the under position of the hollow portion and the storage recess has an opening which faces downward; and a lighting module is set in the storage recess, wherein the lighting module comprises light emitting diodes, a reflector which reflects light emitted from the diode and a lighting housing to which plural number of the light emitting diodes and the reflector can be installed.

Furthermore, the present invention provides a new ceiling system. In the ceiling system, the plural aforementioned lighting fixtures are attached, and each edge portion of at least one of an air-conditioning unit, an air filter unit and a screen panel is provided so that the edge portion is put and mounted on the top surface of the storage recess of the ceiling system of the lighting fixtures.

Hereinafter, an embodiment of a lighting fixture and a ceiling system which uses the lighting system according to the present invention is explained while referring to FIGS. 1 to 6 if necessary. It should be understood that the present invention is not limited merely to the following examples, and substitutions, omissions, additions, and combinations of each example can be made without departing from the scope of the claims of the present invention. Furthermore, the number, the shape and the like of a device and an element used in the lighting fixture and the system ceiling of the present invention can be changed.

A lighting fixture of the present invention can be used such that, for example, the lighting fixture is suspended in a clean room or the like from a ceiling thereof. A ceiling system of the present invention can be obtained such that plural lighting fixtures are combined and furthermore combined with a beam-like support or the like to form a grid pattern (refer to FIG. 6), for example, and then, an air conditioning unit, an air filter unit, a screen panel or the like is further attached thereto.

(Lighting Fixture)

As shown in the cross sectional view of FIG. 1, a lighting fixture 1 of the embodiment is equipped with a ceiling frame 2 which has an attachment portion 3 existing at the upper end of the frame and used for suspending the fixture from a ceiling, as well as a hollow portion 4 existing below the attachment portion 3. The ceiling frame 2 is further equipped with a storage recess 51, which has an opening facing downward, below the hollow portion 4. In the storage recess 51, a lighting module 6 is provided which includes light emitting diodes 62, a reflector 63 which reflects a light emitted from the light emitting diodes 62 and a lighting housing 61 to which the plural number of the light emitting diodes 62 and the reflector 63 are attached. The lighting fixture 1 is schematically structured as explained above.

In the lighting fixture 1 of the embodiment, the ceiling frame 2, which is used as a housing, has a structure such that an attachment portion 3, an hollow portion 4 and a main frame 5 are integrated. The ceiling frame 2 can be generated at low cost by conducting extrusion molding of an aluminium alloy material or the like.

In the example shown in FIG. 1, an attachment portion 3 is formed at the upper end of a ceiling frame 2. When the lighting fixture 1 is suspended from a ceiling of a clean room or the like, the attachment portion 3 is fixed at the ceiling with a bolt or the like in order to maintain the lighting fixture 1 as a whole in a suspended condition. Here, any method can be selected for said fixing.

The attachment portion 3 shown in the example has a structure wherein a slit 3*a* is provided so that the attachment portion 3 can be suspended from the ceiling with a bolt which is omitted in the figures. The attachment portion is not limited such a structure, and it is possible to design and use a suitable structure if necessary.

A hollow part 4 is provided under the aforementioned attachment portion 3, and an interior space 4*a,* which is a hollow space, is provided with an outer frame 41.

The interior space 4*a* can be used as a space where a cable 7, a power supply unit 8 and the like, which are used for supplying current to a light emitting diode described below, are located. When such an arrangement is adopted, it is possible to achieve a safe and neat wiring arrangement.

A storage recess 51 is formed by a main frame 5 located at the lower portion of the ceiling frame 2. The recess opens downward, and it is structured such that the opening portion 51*a* opens downward as shown in FIG. 1.

A lighting module 6 is installed in the inner space of the storage recess 51. In the example shown in FIG. 1, the lighting module 6, which has a U-shaped lighting housing 61, is structured such that the lighting module 6 is attached to a locking part 58 provided at the main frame 5 with a screw knob 68 having an elastic member 68*a* so that the module can be detachable at a single operation. When the attachment is conducted, the lighting module 6 is stored from an opening portion 51*a* and is fixed.

Furthermore, the storage recess 51 of the example is equipped with a lid part 52 having a transparent cover 52*a,* which can pass light emitted from the lighting module 6 in the storage recess 51 to the outside, in order to cover the opening portion 51*a*. Regarding an opening portion 51 a, the lid part 52 shown in the figure is structured such that a claw portion 52*b* can be locked at an inner edge portion 51*b* in the storage recess 51 to form a one-side hook structure, and the lid part 52 is furthermore fixed by tightening a flat countersunk head screw 57.

Figure 2A:
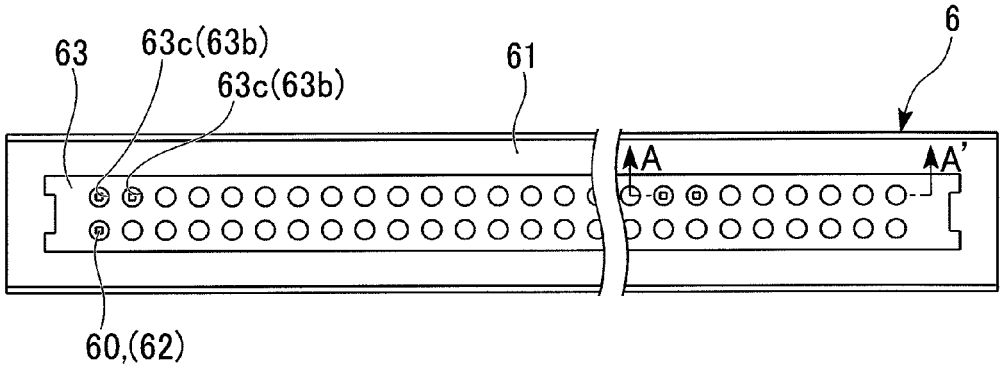
FIG. 2A is a schematic total plan view which shows one example of a lighting module usable in a lighting fixture according to the present invention.
Figure 2B:
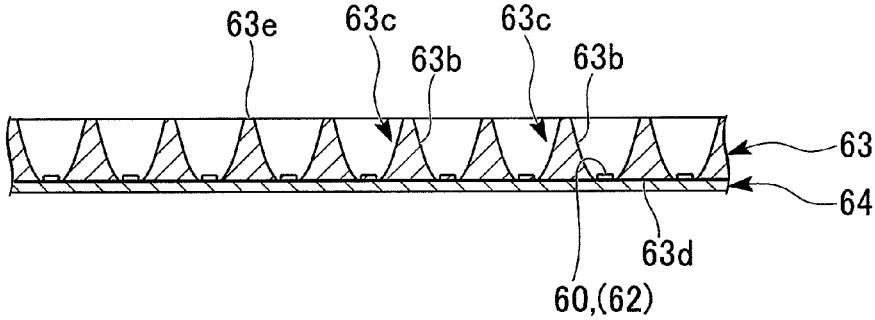
FIG. 2B is a cross sectional view of a lighting module shown in FIG. 2A wherein the lighting module is cut along an A-A' line.

An example of the lighting module 6 is shown in FIGS. 2A and 2B. In the example, a lighting module is structured such that plural light emitting diodes 62 and a reflector 63, which has a structure surrounding the light emitting diodes 62 and can reflect the reflected light of the diodes, are attached to a lighting housing 61.

Furthermore, the lighting module 6 is structured such that a mounting substrate 64, to which plural light emitting diodes 62 are attached, is joined to a reflector 63 which is a rectangle as a whole in planar view, and they are located in a lighting housing 61. Furthermore, in the examples shown in the figures, reflector openings 63*c,* which are used in combination with each light emitting diode 62, are provided in line at even intervals. Here, conditions such as the number, the shape and the like of a reflector, a reflector opening and the like can be changed if necessary. For example, the number of reflectors which exist in the lighting housing may be one or more such as two, four or the like, and it is also possible that multiple lighting housings are provided.

The lighting housing 61 is a housing wherein the reflector 63 and the mounting substrate 64 to which the light emitting diodes 62 were attached are installed. In the example shown in FIG. 1, the lighting housing 61 of the embodiment is formed by bending a metal plate into a U-shape. The shape and the material of the lighting housing can be selected as necessary, in so far as problems are not caused.

At the upper surface 61*a* side of the lighting housing 61, the aforementioned screw knob 68 having the elastic member 68*a* is provided.

As the light emitting diode 62, for example, a generally-known LED chip can be used without any limitation. In examples shown in FIGS. 2A and 2B, the light emitting diodes 62, which are in condition of being covered with a phosphor containing transparent resin object 60 (phosphor containing transparent resin), are mounted on a chip mounting portion provided on the mounting substrate 64. Due to the combination of the light emitting diodes 62 and the reflector 63 having plural reflector openings which are described below, structure is formed wherein each light emitted from the light emitting diodes 62 is reflected and light is irradiated to the certain direction. As the mounting substrate 64 to which the light emitting diodes 62 are attached, generally known printed boards and the like can be used without any limitation.

Figure 3A:
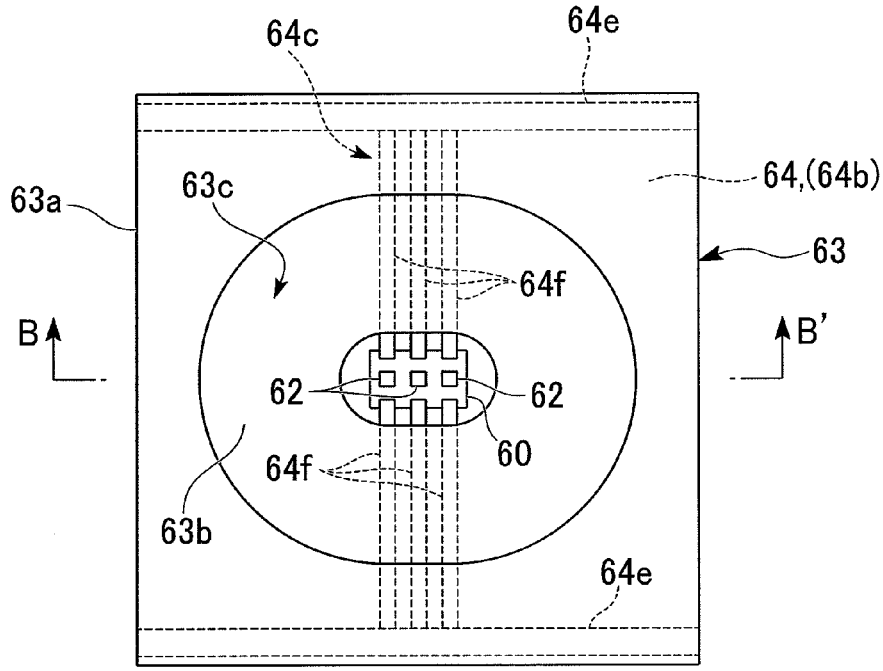
FIG. 3A is a schematic partial plan view which shows one example of a lighting module of a lighting fixture according to the present invention.
Figure 3B:
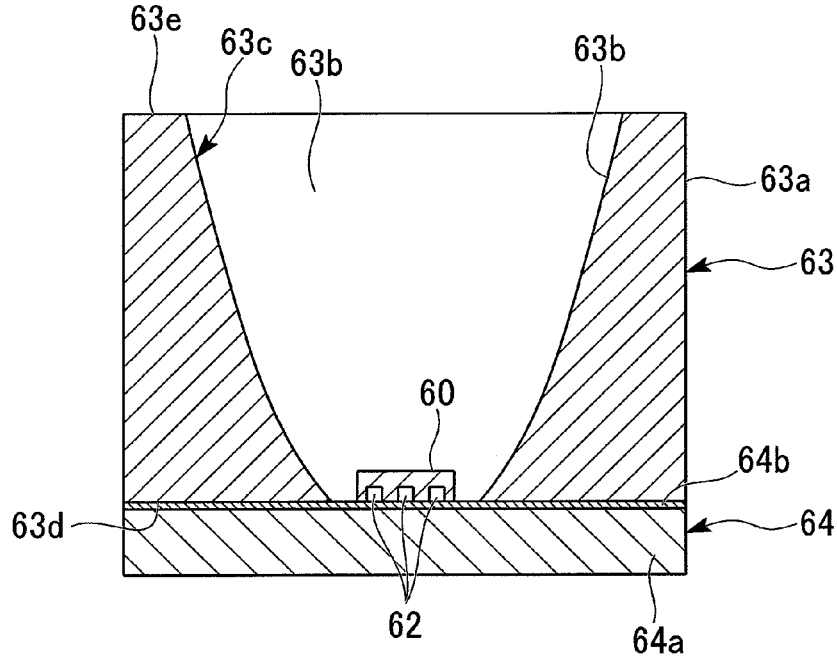
FIG. 3B is a partial cross sectional view of a lighting module shown in FIG. 3A wherein the lighting module is cut along a B-B' line.

Moreover, as shown in partial enlarged views of FIGS. 3A and 3B, the lighting module 6 of the embodiment has a three-chip structure wherein three light emitting diodes 62 are used in combination in a reflector opening 63*c*. The three light emitting diodes 62 are in a state wherein the light emitting diodes 62 are covered with the phosphor containing transparent resin object 60. In examples shown in the figures, the combination of three light emitting diodes 62 and one reflector opening 63*c*, in which the diodes are located, is disposed on a mounting substrate 64 which includes a substrate body 64*a* made of aluminum, an insulating layer 64*b* laminated on the substrate body 64, and a wiring pattern 64*c* which is formed on this insulating layer 64*b* and consists of a conductor such as Cu. The wiring pattern 64*c* includes a pair of an extraction electrode pattern 64*e* and terminal electrode patterns 64*f* which are six in total and exist from one end of the extraction electrode patterns 64*e* to the almost center of the mounting substrate 64. The terminal electrode patterns 64*f* are formed in groups of three, and each of three electrode patterns 64*f* are connected to an extraction electrode pattern 64*e* and three light emitting diodes 62, and therefore, the light emitting diodes 62 are connected in parallel with each other.

In the embodiment, the three light emitting diodes 62 are mounted on the almost center of the chip mounting portion of the mounting substrate 64 as shown in FIGS. 3A and 3B.

Although it is omitted in the figures, the light emitting diodes 62 in the example have a face-up structure. That is, each of a positive electrode and a negative electrode of the light emitting diodes 62 faces the side opposite to the surface where the light emitting diode 62 contacts the mounting substrate 64. That is, the positive and negative electrodes face in the direction toward an opening portion. Furthermore, the positive electrode, the negative electrode and the terminal electrode patterns 64*f* are electrically connected to each other with a wire bonding which is not illustrated. Although the type, the size and the like of the light emitting diodes 62 are not particularly limited, it is preferable that the light emitting diodes is a square having 0.1 to 30 mm sides.

As mentioned above, the light emitting diodes 62 are completely covered with the phosphor containing transparent resin object 60 which has been molded, and it is structured that all light emitted from the light emitting diodes 62 enter the phosphor containing transparent resin object 60. Due to such a structure, by combining a resin object and a diode if necessary, it is possible to obtain a target effect. For example, when a blue light-emitting diode as the light emitting diode 62 and a yellow phosphor as the phosphor included in the phosphor containing transparent resin are used, it is possible to emit white light.

As shown in FIGS. 2A and 2B and FIGS. 3A and 3B, the reflector 63 is schematically structured such that, for example, reflector openings 63*c*, which are formed with a parabolic reflecting surface 63*b*, are provided on a reflector body 63*a* which consists of aluminium or aluminium alloy. Furthermore, as schematically shown in FIGS. 2A and 2B, the reflector 63 of the embodiment has been formed such that reflector openings 63*c* are arranged in line according to the number and position of the light emitting diodes 62 provided to the mounting substrate 64, and the form over all of the reflector 63 is a schematically rectangle when it is observed as a plane.

The reflector body 63*a* is mounted on the mounting substrate 64 such that one surface 63*d* of the reflector main body 63*a* faces the side where the mounting substrate 64 is provided, and the other surface 63*e* thereof faces the other side. The reflector main body 63*a* has the aforementioned reflector openings 63*c*, which pass through between the one surface 63*d* and the other surface 63*e*. A wall surface which forms the aforementioned reflector openings 63*c* is the aforementioned reflecting surface 63*b*. Furthermore, by mounting the reflector main body 63*a* on the mounting substrate 64, the light emitting diodes 62, which have been provided on the chip mounting portion of the mounting substrate 64, are set in the reflector openings 63*c*, and as a result, the light emitting diodes 62 are in a condition that the light emitting diodes 62 are surrounded by the reflecting surface 63*b*.

The aforementioned reflector 63 is structured such that the reflector is set to a lighting housing 61, to which the light emitting diodes 62 and the mounting substrate 64 have been attached, with engagement elements which are omitted in the figures such as a screw fastening member and an engagement claw.

Here, the reflector openings 63*c* in the reflector 63 shown in FIG. 3A are slightly oval when it is observed as a plane, but it is also possible to adopt reflector openings which are a complete round when it is observed as a plane. In the present invention, the form and the size of the reflector are not limited at all.

The aforementioned lighting module 6 usable for the lighting fixture 1 of the embodiment can be structured, for example, in the manner described below in detail.

For example, as the reflector 63, a rectangular reflector 63 (240 mm×32 mm) having parabolic reflector openings 63*c*, which are arranged into 2 rows×15 lines at a pitch of 16 mm, can be used as a unit in the structure such as those shown in a schematic views of FIG. 2A and FIG. 2B. Here, the aforementioned rectangular reflector 63 and a mounting substrate 64, wherein plural light emitting diodes 62 are set and have the form and the size corresponding to the rectangular reflector 63, can be used as an one pair. Here, positioning between the reflector 63 and the mounting substrate 64 is conducted such that the light emitting diodes 62 are set to each reflector opening 63*c* so that the center axis of the opening and the center axis of the light emitting diodes 62 align (in the examples shown by the figures, the center axis of the light emitting diodes 62 represent a center axis of a phosphor containing transparent resin object 60 which coats the light emitting diodes 62).

The material, the form, the number and the like of the reflector 63 can be changed if necessary. For example, the reflector 63 can be generated by injection molding of a polycarbonate material. Furthermore, the reflector 63 may have a structure having mirror reflection when an aluminium vapor deposition is conducted for the inner surface of the reflector openings 63*c*.

Moreover, the type, the size, the form and the like of the light emitting diode 62 can be selected if necessary. For example, a light emitting diode can be used which has a blue LED chip of a 0.35 mm square with height of 80 μm. Furthermore, as shown in FIGS. 3A and 3B, when three of such a light emitting diode 62 are mounted and sealed with a phosphor containing transparent resin object 60 wherein a transparent resin includes a phosphor which can emit yellow light, a structure which can emit white light can be formed. Furthermore, as the light emitting diode 62 usable in the example, for example, it is possible to use a light emitting diode, which can generates luminescence output of 10 mW per one diode when drive current of 20 mA is applied.

Furthermore, in the embodiment, it is also possible to adopt a structure wherein a white LED package or the like is used instead of the light emitting diode 62 which is a LED chip.

A cable 7 described below may be connected to the mounting substrate 64 to which the aforementioned light emitting diodes 62 are mounted. Due to the cable 7, it is possible to adopt a structure wherein a lighting module 6 is bonded by wiring to a power supply unit 8 described bellow, which can be set in the hollow portion 4 of the ceiling frame 2.

The lighting module 6 structured as described above can be connect to or be disconnected from the interior of a storage recess 51 by a single operation.

A cable 7 (which are omitted in the figures) are a power distribution cable connected with external terminals 64*g* (which are omitted in the figures) provided to the mounting substrate 64 in order to supply drive current to the light emitting diodes 62. The cable 7 may be structured with conventionally known cables used for power distribution.

The cable 7 can be introduced into the hollow part 4 such that the cable is inserted through an opening, which is omitted in the figures and provided at the storage recess 51. The cable 7 supplies LED drive current, which is outputted from a power supply unit 8 described below, to the mounting substrate 64 (light emitting diodes 62).

A power supply unit 8 (which is omitted in the figures) is provided in the hollow portion 4, and the power supply unit 8 converts power supply, which is sent by a provided commercial power cable being led from a ceiling, to a predetermined voltage and a predetermined current, and they are supplied as constant voltage and constant current to the light emitting diodes 62.

In the lighting fixture 1 of the embodiment, the lighting module 6 having the aforementioned structure is stored in the storage recess 51 located in the ceiling frame 2, and the cable 7 and the power supply unit 8 are provided at the hollow portion 4. While such an assembly state is maintained, the assembly is carried into, for example, an installation area such as a clean room. Since the construction method is conducted such that a unit type lighting fixture 1 is installed to a ceiling, it is not necessary to conduct troublesome wiring and the like during the work, and it is possible to conduct the construction efficiently for a short period of time.

In the lighting fixture 1 of the embodiment, attachment and fixing of the lighting module 6 to the storage recess 51 is conducted by engaging the screw knob 68 having the elastic member 68*a* with the locking part 58 provided at the main frame 5. However, the lighting fixture of the present invention is not limited merely to this structure.

Figure 4:
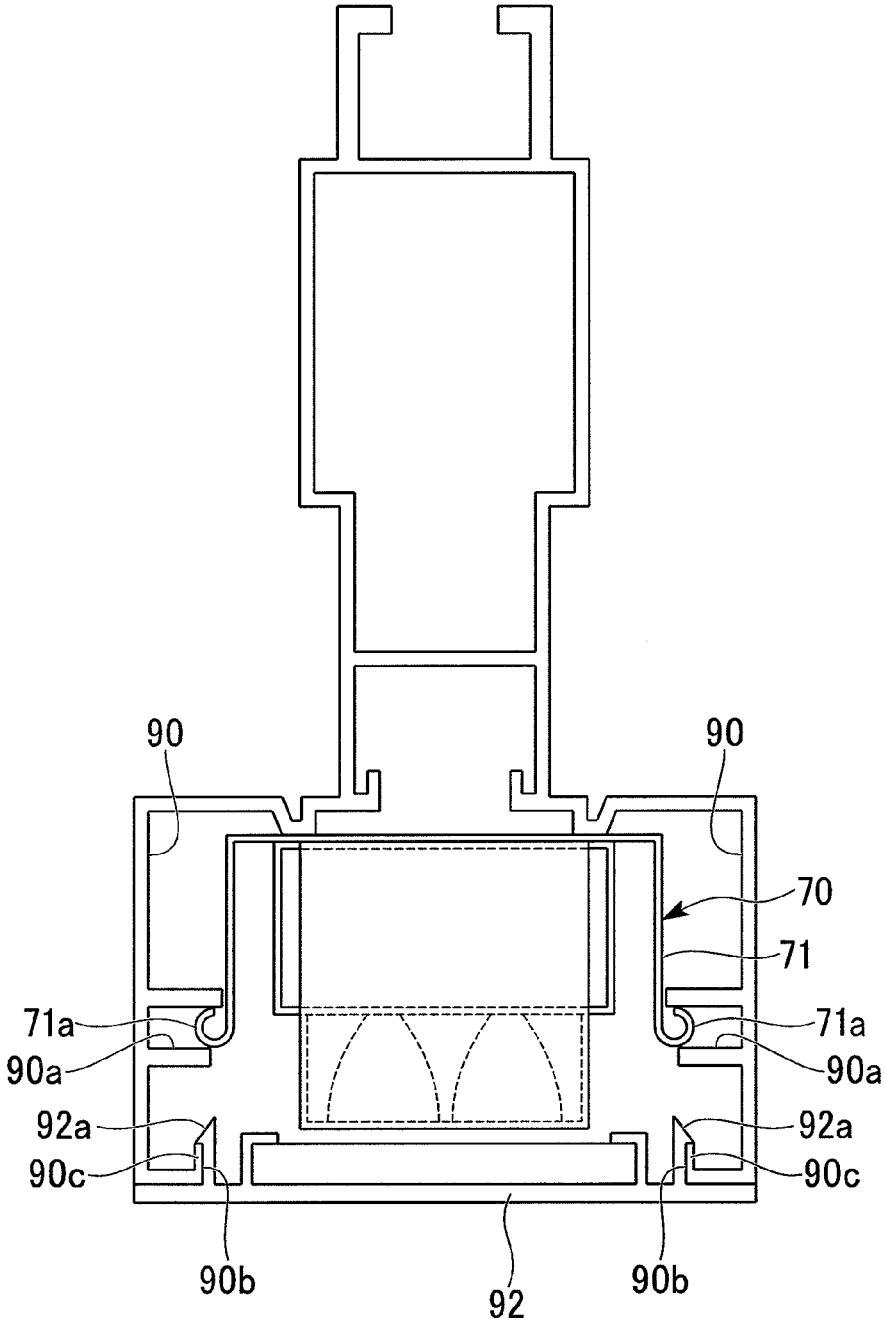
FIG. 4 is a schematic cross sectional view which shows one example of an installation form of a lighting module of the lighting fixture according to the present invention.

For example, the structure wherein engagement is conducted as shown in FIG. 4 is possible. Concretely, end portions 71*a* of a U-shaped lighting housing 71 are bent and turned up to form a cylinder shape, and when a lighting module 70 is stored in a storage recess 90, the aforementioned end portions 71 a enters in locking parts 90*a* provided at a storage recess 90 due to the elastic deformation thereof, and engagement is conducted.

Figure 5:
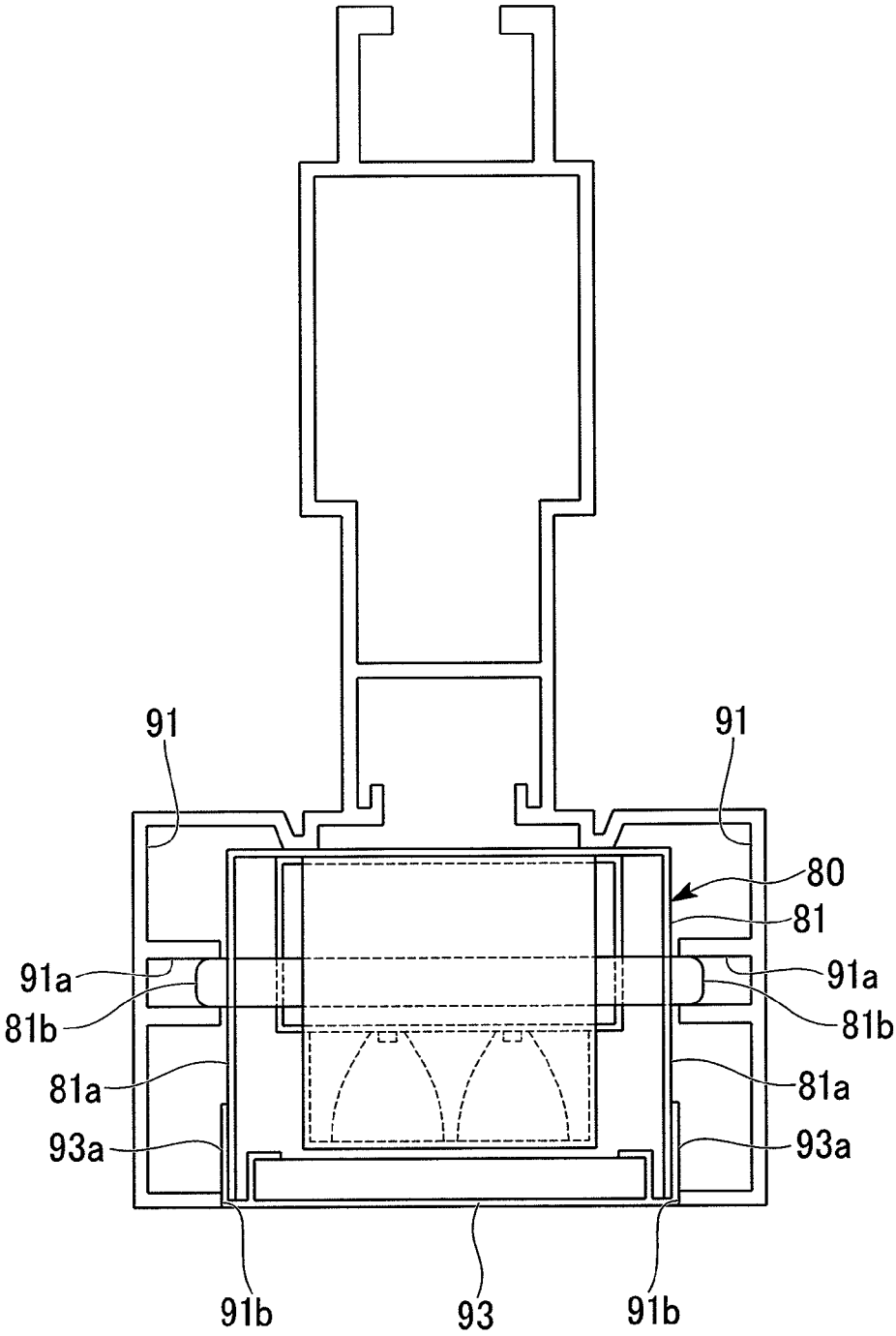
FIG. 5 is a schematic cross sectional view which shows one example of an installation form of a lighting module of the lighting fixture according to the present invention.

Moreover, a structure wherein engagement is conducted as shown in FIG. 5 is also possible. Concretely, side walls 81*a* of a U-shaped lighting housing 81 are equipped with engaging protruding portions 81*b*, which are horizontally movable by being urged by a spring means or the like which is omitted in the figures. When a lighting module 80 is stored in a storage recess 91, the aforementioned engaging protruding portions 81*b* enter into locking part 91*a* provided in the storage recess 91 to conduct engagement.

In the lighting fixture 1 shown in FIG. 1, the attaching structure of a lid part 52 which covers an opening portion 51 a of the storage recess 51 is a one-side catch structure wherein a claw portion 52*b* is engaged with the inner edge portion 51*b* in the storage recess 51, and furthermore the lid part is fixed with a flat countersunk head screw 57. However, the structure of the present invention is not limited merely to such a structure, and the structure can be changed if necessary.

For example, as shown in FIG. 4, a both-side engaging structure can be adopted wherein a lid part 92, which covers an opening portion 90*b* of the storage recess 90, is attached, and claw portions 92*a* provided at the lid part 92 are engaged to the locking parts 90*c* of the storage recess 90.

Furthermore, a structure as shown in FIG. 5 is also possible wherein a lid part 93, which covers an opening portion 91*b* of a storage recess 91, is attached, and side walls 93*a* provided at the lid part 93 are attached such that the walls are inserted into side walls 81*a* of a lighting housing 81.

As explained above, the lighting fixture of the embodiment have a structure wherein the ceiling system 2 includes the storage recess 51 in which a lighting module 6 can be set, and the lighting module 6 is set in the storage recess 51. Accordingly, it is possible to install the lighting fixture 1 easily at an area where the lighting fixture should be set such as a clean room and the like, and construction period for installation is short. Furthermore, the lighting module is not protruded toward the installation area, and it is possible to effectively use an area where the lighting fixture is installed such as a space of a clean room or the like.

Furthermore, since a lighting module 6 is equipped with light emitting diodes 62 and a reflector (reflector openings 63*c*), lifetime thereof is long as compared with a lighting which uses an illuminant such as a fluorescent lamp. Accordingly, the frequency of having to exchange the fluorescent lamp and the like at the installation area can decrease. Furthermore, even when it is necessary to exchange the lighting module 6, exchange operation can be conducted easily and safely since the lighting module 6 having plural light emitting diodes 62 can be set and removed in one operation easily.

Furthermore, since the lighting module 6 is structured such that it is not protruded outside of the lighting fixture 1, a user's body or instruments do not contact with the light emitting diode 62 which is a luminescence means. Therefore, it is possible to prevent breakage and the like of the lighting module and also possible to prevent dust and the like covering on the lighting module.

Accordingly, a lighting fixture can be obtained which is excellent in space efficiency and workability at the time of installation work, maintenance properties and dustproof properties thereof are excellent, and it enables the reduction in construction costs and running costs.

(Ceiling System)

Figure 6:
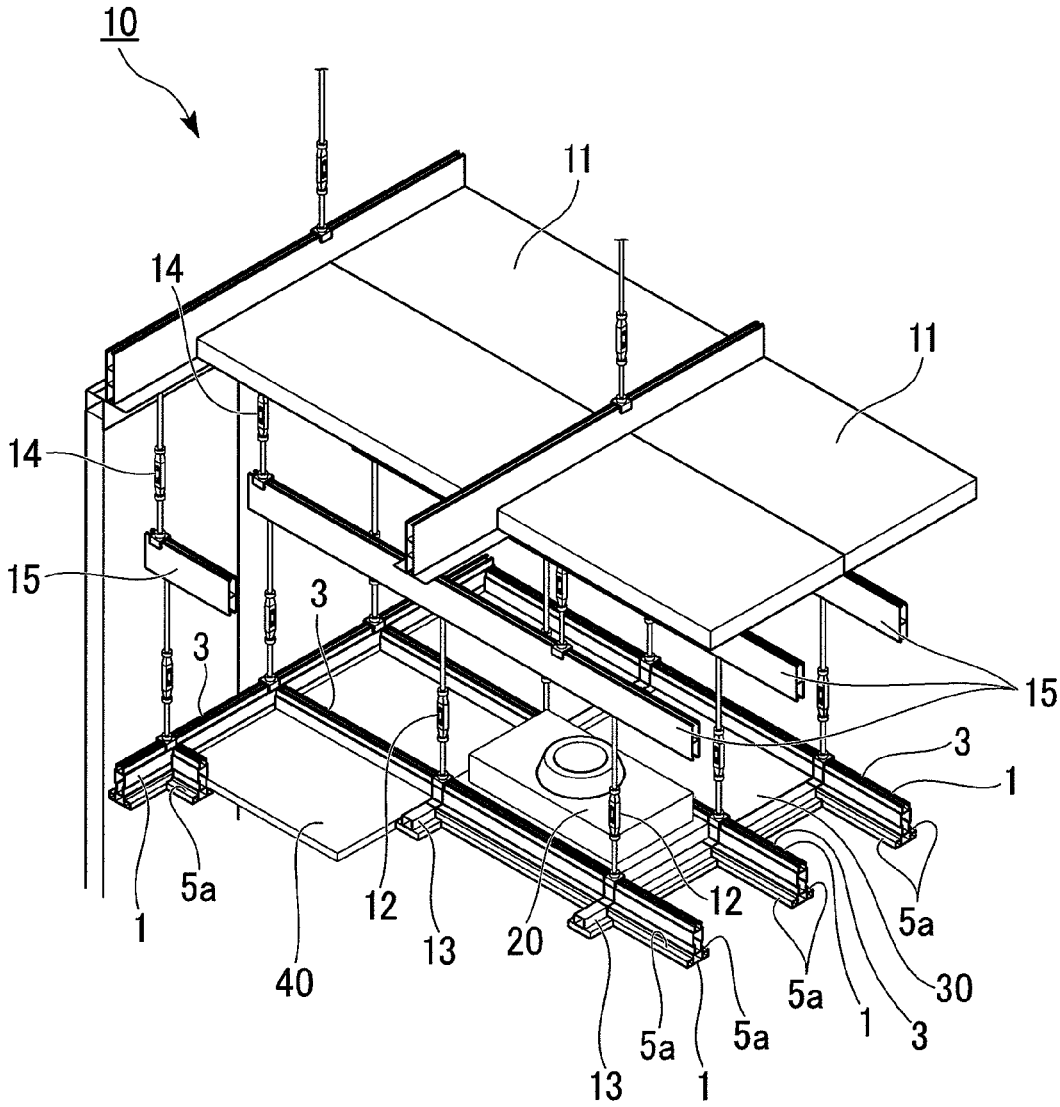
FIG. 6 is a schematic view which shows one example of a ceiling system according to the present invention, wherein the ceiling is in condition of being attached to a clean room.
Figure 7A:
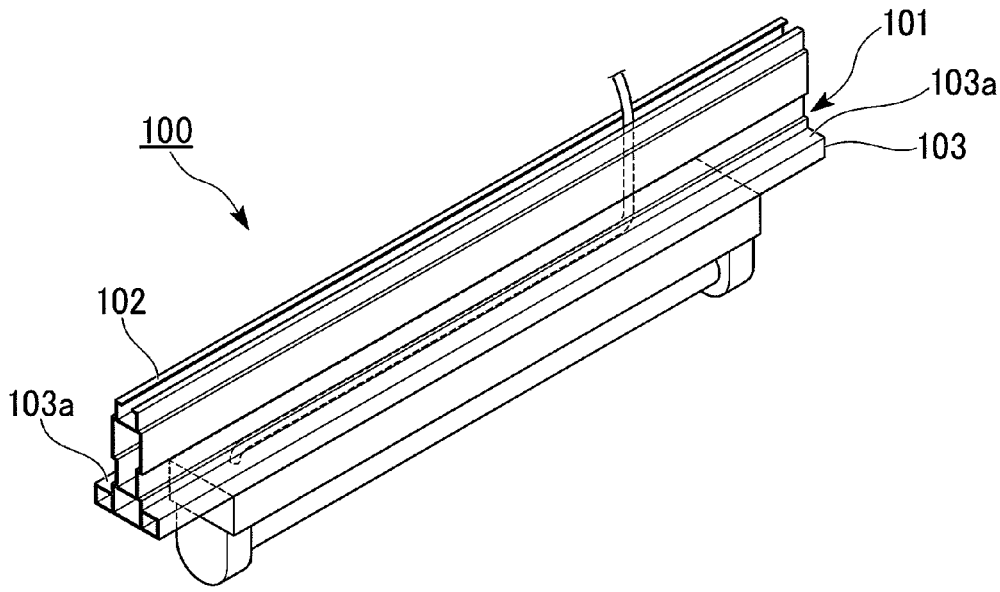
FIG. 7A is a schematic view which for explaining a conventional lighting fixture.
Figure 7B:
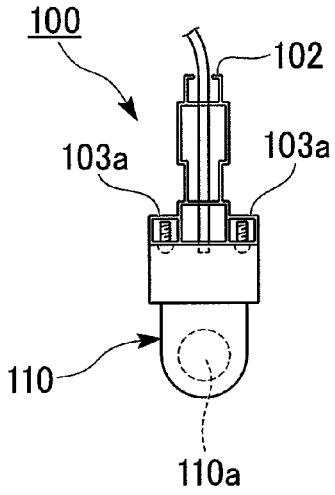
FIG. 7B is a schematic cross sectional view for explaining a conventional lighting fixture.
Figure 7C:
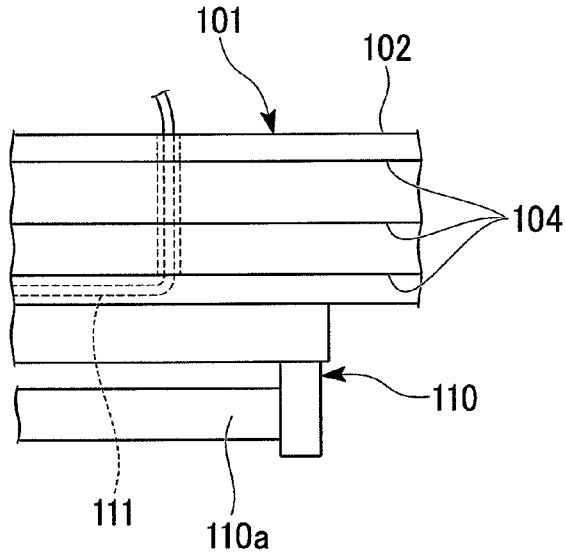
FIG. 7C is a schematic partially enlarged view for explaining a conventional lighting fixture.

In a ceiling system 10 of the embodiment, the aforementioned lighting fixture according the present invention is used. As shown in FIG. 6, a ceiling system 10 is equipped with lighting fixtures 1 which are described above. Furthermore, the ceiling system is schematically structured such that, on the top surface 5*a* of the storage recess 51 which is provided at the ceiling frame 2 of the lighting fixture 1, an edge portion of at least one of an air-conditioning unit 20, an air filter unit 30 and a screen panel 40 is mounted. FIG. 6 shows a structure that all of the aforementioned air-conditioning unit 20, the air filter unit 30 and the screen panel 40 are provided. The number, the position, the type or the like of the air-conditioning unit, the air filter unit and the screen panel can be selected if necessary.

In the ceiling system 10 shown in FIG. 6, the aforementioned lighting fixture 1 is installed to a ceiling (slab of the upper floor) 11, via a hang bolt 12, a suspension tool 15 and a ceiling hang bolt 14. In examples shown in the figure, lighting fixtures 1, which have a rectangular shape when it is observed from above, are installed such that columns of the lighting fixtures, wherein the lighting fixtures are arranged in line, are further arranged in parallel. Furthermore, at the end portions of the columns of the lighting fixtures 1, another lighting fixtures 1 are installed straightly. In addition, between the columns of the lighting fixtures 1, plural rectangular support beams 13 are installed by screw fastening means, which are omitted in the figures, such that the support beams are perpendicular to the columns of the lighting fixtures 1. Thus, a grid-like beam as shown in the illustrated example is constituted. The length and the width of the lighting fixtures 1 can be selected if necessary.

An air-conditioning unit 20, an air filter unit 30 and a screen panel 40 are installed such that they are appropriately located to the grid area which is formed with the aforementioned lighting fixtures 1 and the rectangular support beams 13. In this time, the aforementioned air-conditioning unit 20, the air filter unit 30 and the screen panel 40 are supported under the ceiling of a building 11 such that edge portions of each of the units and the panel are mounted on the top surface 5*a* of the lighting fixtures 1.

In the lighting fixture 1, a cable 7 and a power supply unit 8, which supply drive current to the light emitting diode 62, can be stored in the hollow part 4 in advance. Accordingly, it is not necessary to place troublesome wiring and the like under the condition that the lighting fixture 1 has been suspended from the ceiling 11, and therefore, work becomes easy, work conditions become well, and it is possible to decrease the construction time thereof to a great degree. Furthermore, since the lighting module 6 is stored in the storage recess 51 of the ceiling system 2, the lighting module (lighting means) is not protruded to the space where the lighting fixture is used. Therefore, for example, changes of design or construction, such as change of height of the ceiling 11, are not necessary, and it is not necessary to decrease the space where the lighting fixture is installed.

In the ceiling system 10 of the embodiment shown in FIG. 6, a structure is adopted wherein the lighting fixture 1 is set to the ceiling 11 via the hang bolt 12, the suspension tool 15 and the ceiling hang bolt 14 as described above. However, the present invention is not limited thereto. For example, such a structure is possible wherein a hang bolt 12 is set to the ceiling 11 without setting it via a suspension tool 15 and a ceiling hang bolt 14, or wherein an attachment portion 3 of the lighting fixture 1 is directly fixed to the ceiling 11.

Furthermore, in the ceiling system 10 as shown in the example of the figure, support beams 13 are installed such that they are perpendicular to the lighting fixtures 1 to form a grid-like beam. However, for example, it is also possible to constitute all beams of a grid with lighting fixtures 1 without using any support beams 13.

The aforementioned ceiling system 10 of the embodiment is a ceiling system which is structured with the lighting fixture according to the present invention, wherein a lighting module can be stored within a storage recess provided at a ceiling frame. Therefore, it is possible to achieve similar effects achieved by the lighting fixture 1. For example, when the ceiling system 10 of the embodiment is set as a ceiling for a clean room or the like, installation work for lighting fixtures 1, air-conditioning units 20, air filter units 30, screen panels 40 and the like can be conducted easily at the area where the ceiling system should be installed. Therefore, it is possible to install them with a short construction time. Furthermore, the lighting module is not protruded toward the interior of a clean room where the ceiling system is installed, and it is possible to use space of the area where the ceiling system is installed effectively.

Moreover, as described above, the lighting fixture 1 which is set to the ceiling system 10 uses the lighting module 6 equipped with the plural light emitting diodes 62 and the reflector 63 (reflector openings 63). Accordingly, such a structure makes it possible to conduct long-life lighting and the frequency of having to exchange the lighting module or the like can be decreased, and furthermore, the exchange of a lighting module 6 can be conducted in one operation easily and safely.

Accordingly, it is possible to obtain a ceiling system 10, which is excellent in space efficiency, workability at the time of installation work thereof and dustproof properties, and the ceiling system 10 enables to reduce construction costs and running costs thereof and maintenance thereof is easy.

Although the ceiling system 10 of the embodiment is explained based on the example wherein the ceiling system is installed in a clean room, a lighting fixture and a ceiling system of the present invention are not limited thereto. For example, a lighting fixture and a ceiling system of the present invention can be used in various inspection institutions, food factories, warehouses and building spaces without any limitation. In such cases, effects similar to those of the aforementioned example can be achieved.

INDUSTRIAL APPLICABILITY

A lighting fixture and a ceiling system which uses the lighting fixture are provided wherein the lighting fixture is excellent in space efficiency, work time required for installation thereof is short, maintenance thereof is easy, dustproof properties thereof are excellent, and reduction of construction costs and running costs is possible.

The invention claimed is:

1. A lighting fixture which comprises a ceiling frame equipped with an attachment portion, a hollow portion and a storage recess, wherein the attachment portion is located at an upper end portion of the frame to be suspended from a ceiling, the hollow portion is located below the attachment portion and the storage recess is located below the hollow portion; and the storage recess has an opening which faces downward, a lighting module is set in the storage recess, and the lighting module includes plural light emitting diodes, a reflector which reflects light emitted from the diodes and a lighting housing to which the light emitting diodes and the reflector are installed.

2. The lighting fixture according to claim 1, wherein a cable which supplies a power supply to the light emitting diodes is provided in the hollow portion.

3. The lighting fixture according to claim 2, wherein a power supply unit which supplies a power supply to the light emitting diodes is provided in the hollow portion.

4. The lighting fixture according to claim 1, wherein the lighting module is detachably set in the storage recess provided at the ceiling frame.

5. A ceiling system to which plural lighting fixtures and at least one of an air-conditioning unit, an air filter unit and a screen panel are attached;

each of the lighting fixtures comprise a ceiling frame equipped with an attachment portion, a hollow portion and a storage recess, wherein the attachment portion is located at an upper end portion of the frame to be suspended from a ceiling of a building, the hollow portion is located below the attachment portion, and the storage recess is located below the hollow portion; and the storage recess has an opening which faces downward, a lighting module is set in the storage recess, and the lighting module includes plural light emitting diodes, a reflector which reflects light emitted from the diodes and a lighting housing to which the light emitting diodes and the reflector are installed; and an edge portion of at least one of the air-conditioning unit, the air filter unit and the screen panel is mounted on the top surface of the storage recess of the ceiling system of the lighting fixtures.

6. The ceiling system according to claim 5, wherein a cable which supplies a power supply to the light emitting diodes is provided in the hollow portion.

7. The ceiling system according to claim 6, wherein a power supply unit which supplies a power supply to the light emitting diodes is provided in the hollow portion.

8. The ceiling system according to claim 5, wherein the lighting module is detachably set in the storage recess provided at the ceiling frame.

* * * * *